US006662709B1

(12) United States Patent
Beutler

(10) Patent No.: US 6,662,709 B1
(45) Date of Patent: Dec. 16, 2003

(54) HOLLOW PISTON FOR A PISTON ENGINE AND METHOD FOR PRODUCING A HOLLOW PISTON

(75) Inventor: Gerhard Beutler, Nagold (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 15 days.

(21) Appl. No.: 10/019,737

(22) PCT Filed: Jun. 30, 2000

(86) PCT No.: PCT/EP00/06140

§ 371 (c)(1),
(2), (4) Date: Jan. 4, 2002

(87) PCT Pub. No.: WO01/07201

PCT Pub. Date: Feb. 1, 2001

(30) Foreign Application Priority Data

Jul. 21, 1999 (DE) ..... 199 34 216

(51) Int. Cl.[7] ..... B23P 15/10; F04B 1/12

(52) U.S. Cl. ..... 92/176; 29/888.042; 29/888.044; 92/260

(58) Field of Search ..... 92/172, 176, 187, 92/260; 29/888.042, 888.044, 888.047

(56) References Cited

U.S. PATENT DOCUMENTS

| | | | | |
|---|---|---|---|---|
| 3,319,575 A | 5/1967 | Havens | | |
| 4,494,448 A | 1/1985 | Eystratov et al. | ..... | 92/172 |
| 5,216,943 A | 6/1993 | Adler et al. | ..... | 92/157 |
| 5,642,654 A | 7/1997 | Parekh et al. | ..... | 92/260 |

FOREIGN PATENT DOCUMENTS

| | | | |
|---|---|---|---|
| DE | 26 53 867 A1 | | 6/1978 |
| DE | 34 06 782 A1 | | 8/1984 |
| DE | 41 08 786 C2 | | 9/1992 |
| DE | 196 20 167 C2 | * | 3/1997 |

* cited by examiner

*Primary Examiner*—Edward K. Look
*Assistant Examiner*—Thomas E. Lazo
(74) *Attorney, Agent, or Firm*—Scully, Scott, Murphy & Presser

(57) ABSTRACT

A hollow piston (1) piston engine including a closed annular cavity (9). Said hollow piston constituted of a first piston part (1*a*) with a base section (3) from which a joint part (4) extends in one axial direction, and from which a peripheral wall (6) that delimits the annular cavity (9) on the outside, and a mandrel (7) that delimits the annular cavity (9) on the inside extend, each as one piece, in the other axial direction. The hollow piston is also constituted of a second piston part (1*b*) having a cover (8) which is connected to the ends of the peripheral wall (6) and of the mandrel (7), said ends facing away from the base section (3). In order to achieve an economical and simple production while ensuring the provision of a stabile construction, the peripheral wall (6) and the mandrel (7) are formed on the base section (3) without machining.

10 Claims, 4 Drawing Sheets

Fig.1a
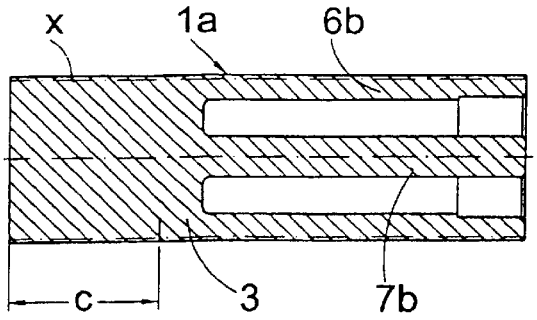
Fig.1b
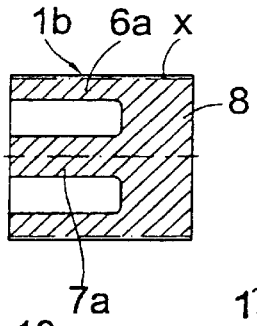
Fig.1c
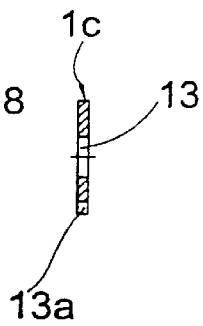
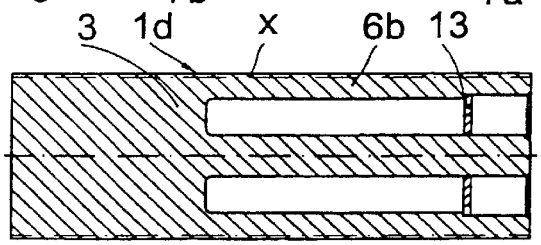
Fig.1d
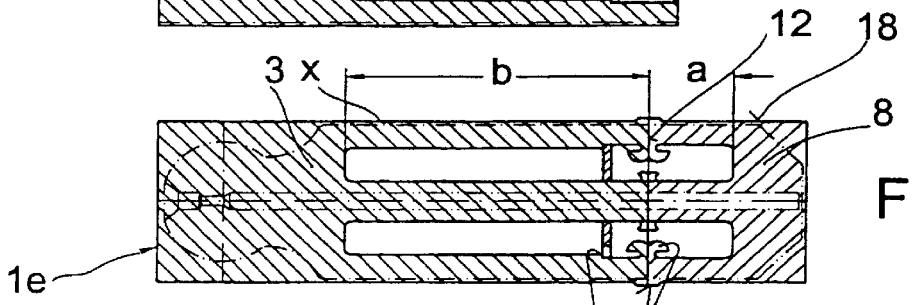
Fig.1e
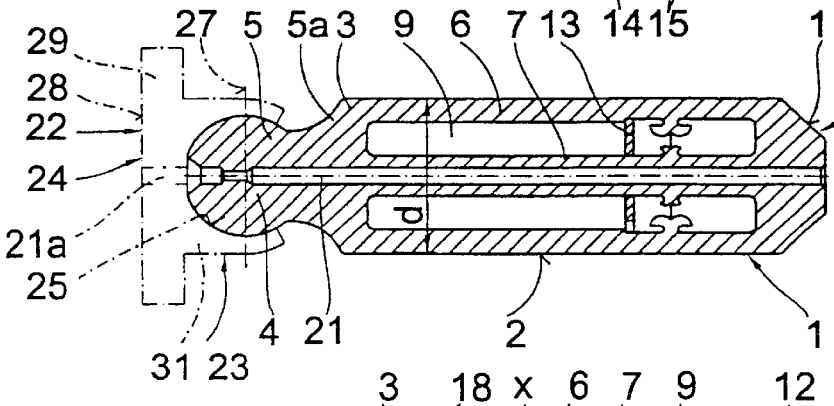
Fig.1
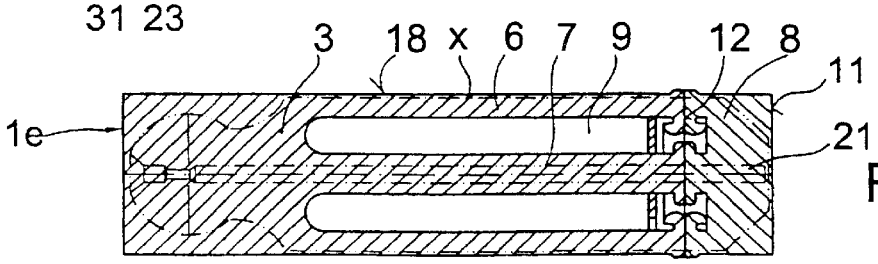
Fig.2

Fig. 3 (Prior art)
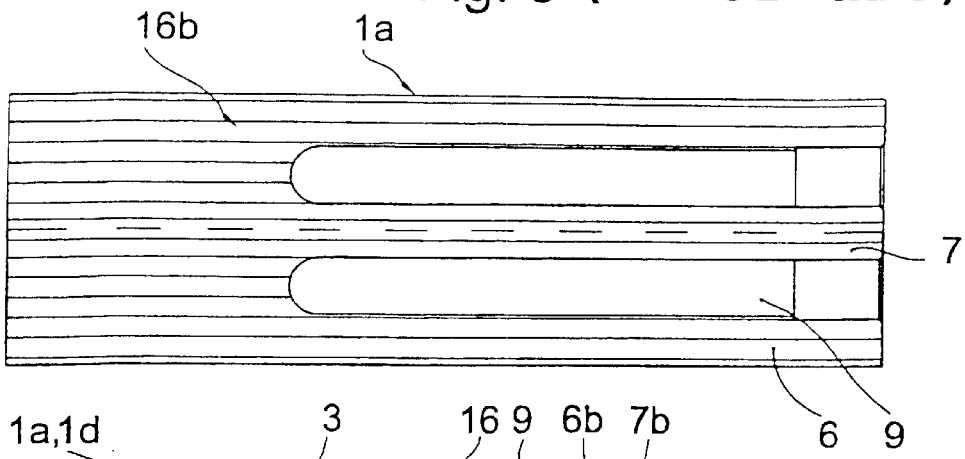
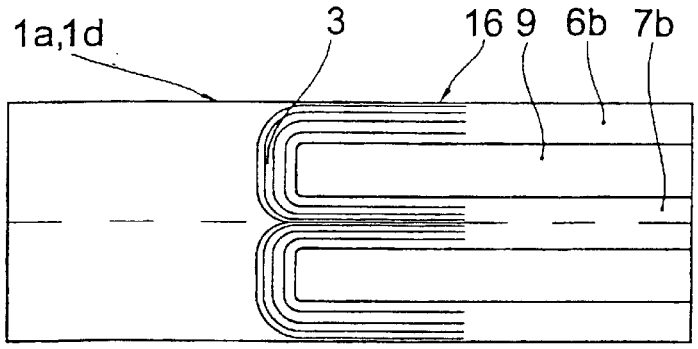
Fig. 4
Fig.5 (Prior art)
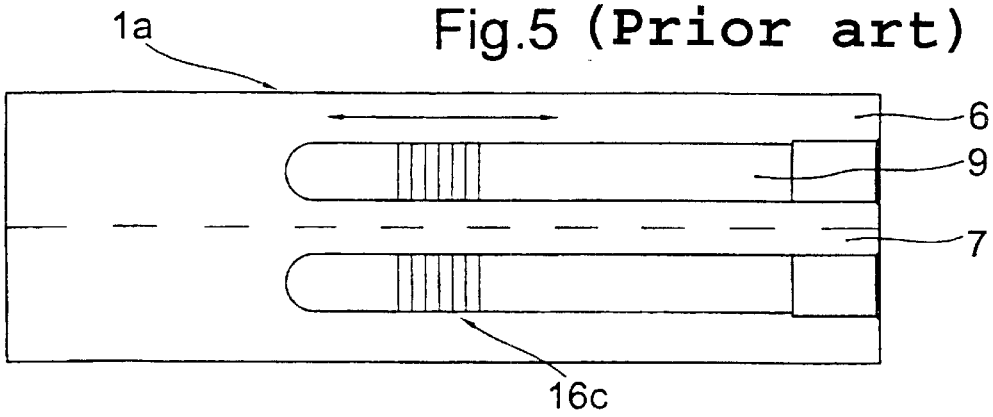
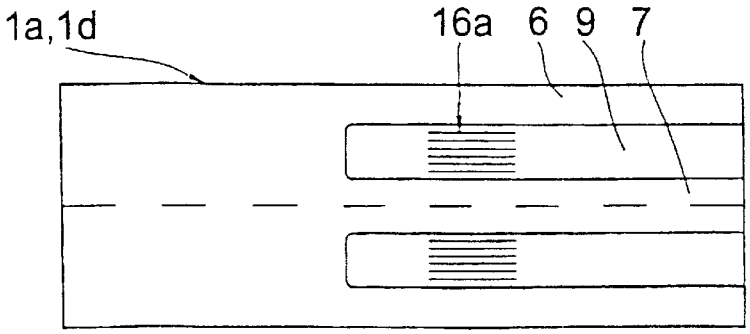
Fig.6

Fig.7a
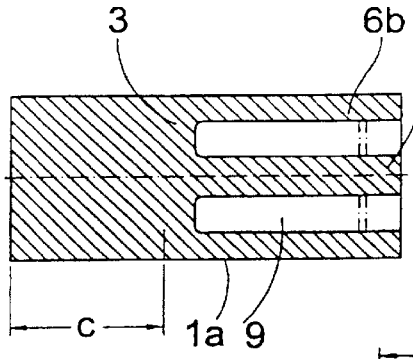
Fig.7b
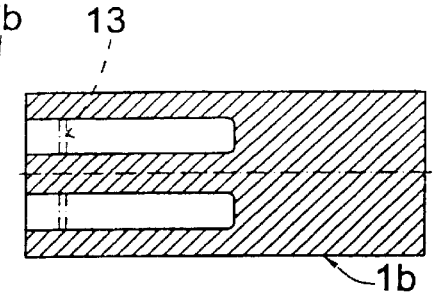
Fig.7c
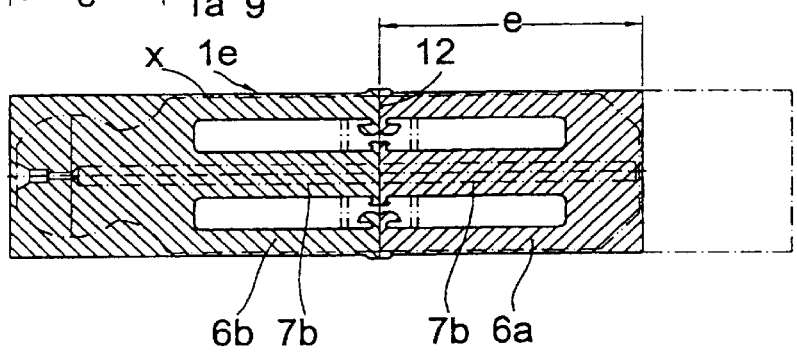
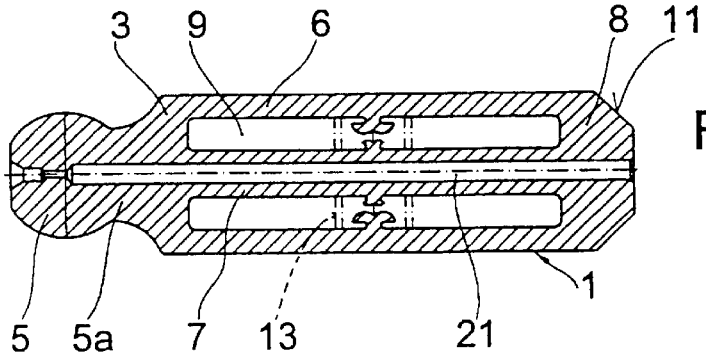
Fig.7

Fig.8a
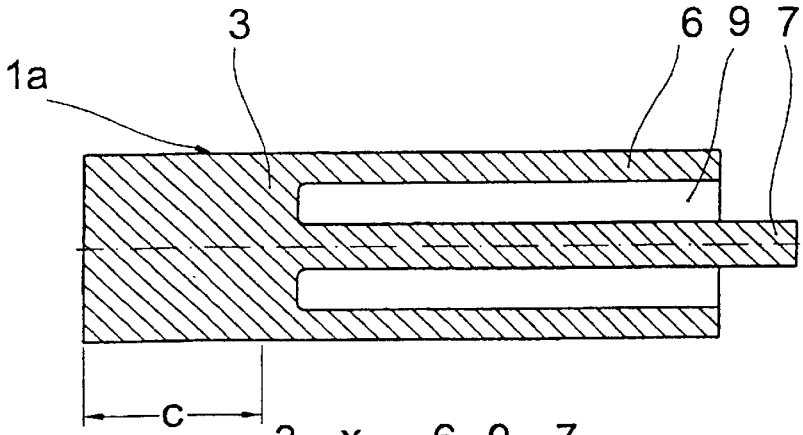
Fig.8b
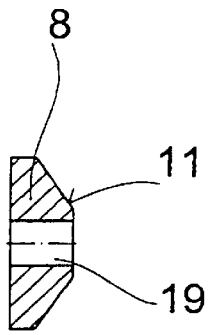
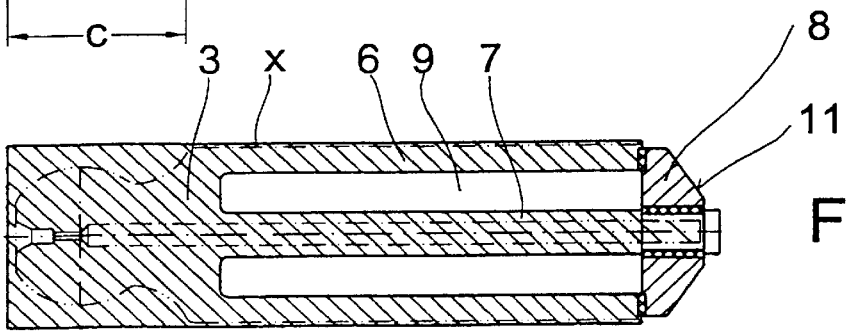
Fig.8c
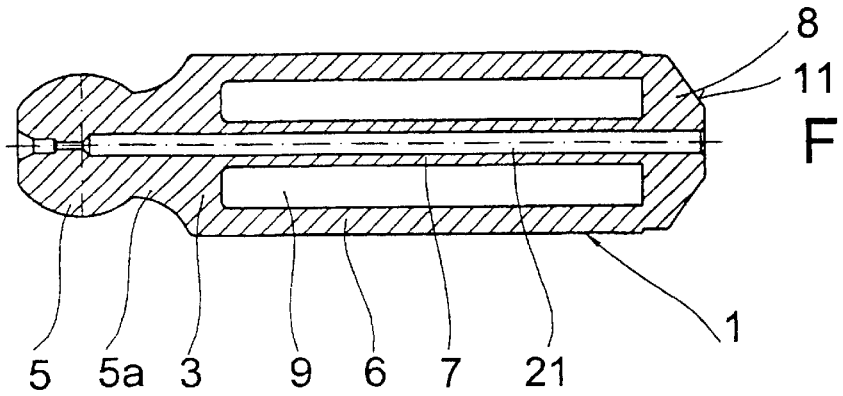
Fig.8

HOLLOW PISTON FOR A PISTON ENGINE AND METHOD FOR PRODUCING A HOLLOW PISTON

A hollow piston in accordance with the prior art is described in DE 196 20 167 C2. In this previously known hollow piston, an annular hole, which is manufactured in a metal-cutting manner by deep-hole drilling, exists between the peripheral wall and the central mandrel. This presupposes an outlay on manufacture which is labour and time-intensive and which gives rise to relatively high manufacturing costs. At the same time, it must be taken into account that the manufacture of this known hollow piston also takes place with a relatively high wastage of material, which comes about because of the incorporation of the annular hole in a metal-cutting manner. Furthermore, this hollow piston has a ball-joint part in the form of a joint ball which extends from the base section of the hollow piston in the opposite axial direction to the cavity.

DE 26 53 867 A1 describes a hollow piston and a process for manufacturing the said piston, which is formed from two separate hollow-piston parts, namely a first piston part comprising the base section, the peripheral wall and the ball-joint part, and a second piston part containing the cover and a central mandrel which extends from the said cover in one piece. In order to stabilise the connection between the first and second piston parts, the cover grips into the hollow piston with the aid of a peg-shaped extension on the free rim of the peripheral wall, and the free end of the mandrel grips into a recess in the base section, the two piston parts being connected to one another by soldering. Although, in this known hollow piston, the peripheral wall of the first piston part on the one hand, and the mandrel of the other piston part on the other are, in each case, formed onto the appertaining piston part in one piece by extrusion, two separate forming operations in two separate forming tools are nevertheless necessary in this known design.

The underlying object of the invention is to construct a hollow piston of the type initially indicated, in such a way that a stable mode of construction is achieved while guaranteeing simple and cost-effective manufacture, and also to indicate a corresponding manufacturing process.

In the case of hollow pistons according to the present invention, the peripheral wall and the central mandrel are formed onto the base section of the hollow piston without cutting. This not only avoids the wastage of material caused by deep-hole drilling in a metal-cutting manner, but also avoids grooves extending in the peripheral direction in the inner superficies of the peripheral wall and in the outer superficies of the mandrel, as a result of which substantially greater stability is imparted to the hollow piston, since the peripheral grooves quite considerably reduce the said piston's resistance to bending loads. Moreover, the forming-on of the peripheral wall and central mandrel in one piece can be performed more simply and rapidly from the production engineering point of view, without the need to dispose of swarf.

It is particularly advantageous to form-on the peripheral wall and central mandrel by extrusion. By this means, not only is shaping achieved which can be performed in a simple and rapid manner, but also material fibres are obtained in the course of extrusion which are directed in the longitudinal direction of the piston, as a result of which the peripheral wall and mandrel have a particularly high moment of resistance to bending loads imparted to them and also, basically, have great strength, a fact which is likewise achieved through extrusion as a result of material and structural compaction.

Alternatively, the peripheral wall and the central mandrel may also be formed, within the scope of the invention, through the fact that the said parts consist, with the base section, of sintered material and are formed and sintered with the annular hole which extends between the peripheral wall and the mandrel. Likewise, as a result of this, not only is simple, cost-effective manufacture achieved, but it is also possible to make use of the advantage that a sintered material is suitable as an antifriction material, this being attributable to the fact that the pores present in a sintered material form lubricant pockets which guarantee good lubrication and relatively low wearing of the sliding surfaces.

The hollow piston according to the invention in accordance with claim 6 consists of two pot-shaped blank sections which are identical as regards the shape and size of their internal shape, that is to say, the shape of the halves of the cavity. As a result of this, it is possible to use identical tools and manufacturing measures, at least for designing the internal shapes of the hollow pistons. This substantially facilitates the manufacturing process, and the manufacturing costs can be lowered considerably.

It is particularly advantageous if the hollow piston is composed of two blank sections or prefabrication parts which are identical not only as regards their internal shape, but also as regards their external shape, and are thus identical. It is therefore necessary to manufacture only one type of prefabrication parts, which are assembled in a mutually opposed disposition and are connected to one another, in particular by welding, and which thus form a piston blank.

The subclaims contain features which contribute to the achieving of the object underlying the invention, make possible a further saving on material and permit a smaller structural length of the hollow piston or of the piston engine as a whole. This latter fact is achieved, in particular, through the fact that the ball-joint part extending from the base section of the hollow piston is formed by a ball socket, whose outer peripheral face can be utilised as the outer superficies and sliding face of the hollow piston, so that the piston guide can extend right over the said ball socket and, consequently, the axial structural length of the piston; engine can be reduced.

The invention, and further advantages which can be achieved by means of it, will be explained in greater detail below with the aid of preferred exemplified embodiments and of drawings, in which:

FIG. 1 shows a hollow piston according to the invention for a piston engine, in axial section;

FIGS. 1*a*, 1*b* and 1*c* show three prefabrication parts which are subjected to further processing to form a piston blank;

FIG. 1*d* shows a prefabrication part which is stabilised by a supporting disc;

FIG. 1*e* shows the piston blank in axial section;

FIG. 2 shows a piston blank in a modified design;

FIG. 3 shows a prefabrication part for the hollow piston in axial section, with the fibre orientation according to the prior art indicated;

FIG. 4 shows, in axial section, a prefabrication part according to the invention, with the fibre orientation indicated;

FIG. 5 shows a prefabrication part for the hollow piston in axial section, according to the prior art;

FIG. 6 shows a prefabrication part according to the invention for the hollow piston, in axial section;

FIG. 7 shows a hollow piston according to the invention, in a modified design and in axial section;

FIGS. 7*a*, 7*b* show two prefabrication parts, which are identical to one another, for the hollow piston according to the invention in accordance with FIG. 7;

FIG. 7*c* shows a piston blank for the hollow piston according to FIG. 7, in axial section;

FIG. 8 shows, in axial section, a hollow piston according to the invention in a design which has been further modified;

FIGS. 8*a*, 8*b* show two prefabrication parts for the hollow piston, in axial section; and FIG. 8*c* shows, in axial section, a piston blank for a hollow piston according to FIG. 8.

The hollow piston, which is designated generally by 1 and has a cylindrical superficies 2, has a base section 3 from which a joint part 4, in the present exemplified embodiment a joint ball 5 with a ball neck 5*a*, extends in one longitudinal direction, and from which a hollow cylindrical peripheral wall 6 and a cylindrical central mandrel 7, which are connected to one another by a cover 8 at their ends that face away from the base section 3, extend in the other longitudinal direction. Located between the peripheral wall 6 and the mandrel 7 is an annular cavity 9 which is closed on all sides. In the present exemplified embodiment, the end face 11 at the front, free end of the hollow piston 1 has a frustoconical shape. However it may also have a different shape and be, for example, a radially planar end face.

The hollow piston 1 is assembled and produced from two or three parts, namely a base body part 1*a* according to figure 1*a*, a cover part 1*b* according to FIG. 1*b* and, optionally, a centering disc 1*c* according to FIG. 1*c*. For the purpose of further developing them to form the piston blank 1*e* according to FIG. 1*e*, the base body part 1*a* and the cover part 1*b* are placed axially against one another at a dividing seam 12 which is located in the longitudinal region of the annular cavity 9, the said dividing seam being at a distance a from the cover 8 and also at a distance b from the base section 3. As a result of this, a section of the annular cavity 9 extends, in each case, both into the base body part 1*a* and also into the cover part 1*b*, which results in peripheral wall sections 6*a*, 6*b* and mandrel sections 7*a*, 7*b* which face towards one another. The centering disc ic is inserted between the peripheral wall 6*b* and the mandrel section 7*b* of the base body part 1*a* (see FIG. 1*d*), the central hole 13 and external diameter of the said disc being adapted to the cross-sectional size of the mandrel section 7*b* and to the internal diameter of the peripheral wall section 6*b*. In this connection, the diameter of the mandrel section 7*b* may be slightly tapered (in a manner which is not represented), or the internal diameter of the peripheral wall section 6*b* may be slightly widened, so that an abutment shoulder 14 for the said centering disc 1*c* is obtained at a short axial distance b from the free end of the base body part 1*a*. The centering disc 1*c* has, preferably on its outer rim, a through-hole 13*a*, for example a notch, which guarantees a flow passage between the two cavity sections which are separated by the centering disc 1*c*.

The external diameters of the base body part 1*a* and of the cover part 1*b* are, in each case, prefabricated with an oversize x with respect to the diameter d of the hollow piston 1. The base section 3 is prolonged, on the base body part 1*a*, by an axial extent c, the length of which is so dimensioned that the joint ball 5 with its ball neck 5*a* can be formed from it, for example by turning in a metal-cutting manner.

In the present exemplified embodiment, the hollow piston 1, or the base body part 1*a* and cover part 1*b*, consist of metal, in particular steel, which is suitable for extrusion.

When they abut at the faces of the dividing seam 12, the base body part 1*a* and cover part 1*b* are connected to one another by welding, preferably by friction welding, which can be achieved by rotation of one part relative to the other part, as is known per se. In the course of friction, the peripheral wall sections 6*b* and the mandrel section 7*b* are heated up so intensively in the region of the dividing seam 12 that they melt in the region of the latter and weld to one another, under which circumstances welding beads 15 may be formed on the inside and outside. During the rotation and the welding operation, the mandrel section 7*b*, in particular, is supported radially by the centering disc 1*c*.

As a result of the welding-together of the base body part 1*a* and cover part 1*b*, a piston blank 1*e* according to figure 1*e* is obtained, in which the radial and axial oversizes x are elucidated by a representation, in chain-dotted lines, of the final shape of the piston.

The exemplified embodiment according to FIG. 2, in which identical or comparable parts are provided with the same reference symbols, shows a piston blank 1*e* which differs from the exemplified embodiment described above, merely in that the dividing seam 12 is shifted more towards the free end of the peripheral wall 6, for example into the vicinity of the cover 8 or up to the cover 8.

The base body part 1*a* and the cover part 1*b* are preferably one-piece formed parts, that is to say their peripheral wall sections 6*a*, 6*b* and mandrel sections 7*a*, 7*b* are formed onto the appertaining base section 3 or cover 8 in one piece in each case. Preferred measures for this purpose may be, for example, sintering and extrusion, in particular cold extrusion. In the first case, the base body part 1*a* and cover part 1*b* are formed through the fact that sintering material is, in each case, fed into a corresponding cavity in a mould and sintered. Extrusion takes place in extruding tools of corresponding shape in each case, which are known per se, the peripheral wall section 6*b* and mandrel section 7*b* in each case, and optionally also the peripheral wall section 6*a* and mandrel section 7*a* in each case, being formed by extrusion on a blank which is not represented. In both cases, sufficient accuracy of shape is obtained for the base body part 1*a* and cover part 1*b*, a sintered part additionally being well suited to a sliding function because of pores which are contained in the sintered material and which act as lubricating pockets under functional operating conditions.

Extrusion results, in each case, in a fibre orientation 16 which extends in a U-shaped manner in that region of the material which adjoins the base region of the cavity 9, as FIG. 4 shows. This fibre orientation is also obtained on the inner superficies of the cavity 9, a fact which is elucidated in FIG. 6 by longitudinally extending lines and the reference numeral 16*a*. In contrast to this, a cavity 9 which is produced by metal-cutting, for example by deep-hole drilling, has, in the base region of the said cavity 9, a fibre orientation 16*b* which is broken or which terminates axially, this being brought about by the manufacture of the starting material, for example by rolling, calibrating or drawing. Furthermore, in the case of production in a metal-cutting manner, for example by deep-hole drilling, the inner wall of the cavity 9 has grooves 16*c* which extend transversely to the longitudinal direction and which lead—as the fibre orientation 16*b*, which is interrupted in the base region of the cavity 9, already does—to the risk of breakage.

A further advantage is that, in the two manufacturing measures described above, no material has to be removed by cutting in order to achieve the desired shape of the annular cavity 9. Optimum use is thus made of the material available.

A process for manufacturing a hollow piston 1 according to FIG. 1 will be described below, with its process steps.

Production, in each case, of at least one base body part 1*a* and of a cover part 1*b* by one-piece forming with a radial oversize x. In those cases in which the dividing seam 12 is located close to the inside of the cover part 1*b*, it may optionally be practicable, within the scope of the invention, to incorporate the peripheral wall section 6*b* and the mandrel section 7*b* of the cover part 1*b*, not by forming in one piece but in a metal-cutting manner, for example by drilling or milling. On the other hand, longer axial sections of the peripheral wall 6 and mandrel 7 are advantageously formed in a one-piece manner, in particular by sintering or extrusion, preferably cold extrusion. Moreover, at least one centering disc 1*c* is constructed, in particular, by punching it out of a plate bar.

Insertion or pressing of the centering disc 1*c* into the base body part 1*a*.

Welding of the base body part 1*a* and cover part 1*b* to form a piston blank 1*e* according to FIG. 1*e*.

Incorporation of a bore 21 which passes through coaxially in the piston blank 1*e* after or before the welding operation in the base body part 1*a* and cover part 1*b*, if the said bore is present.

Hardening or nitriding of the piston blank 1*e*, at least in the region of its superficies 18.

Finish-machining of the surface of the piston blank 1*e* in a metal-cutting manner by, for example, turning and/or grinding.

Within the scope of the invention, the machining of the surface of the piston blank 1*d* in a metal-cutting manner can also take place in a number of steps. Thus, for example, it is possible, after the welding operation and before the hardening operation, to manufacture the shape according to FIG. 1, which corresponds to the final shape of the hollow piston 1, in a metal-cutting manner, for example by turning or grinding, with an oversize at least on the superficies 18 and, after the hardening operation described above, to finish-machine the entire superficies or merely the hollow cylindrical superficies, for example by grinding, it being possible to already finish-machine the joint ball 5 before the hardening operation.

The exemplified embodiment according to FIGS. 7 to 7*c*, in which identical or comparable parts are provided with the same reference symbols, differs from the exemplified embodiment described above in the fact that the base body part 1*a* and cover part 1*b* are of identical construction, at least in the region of their peripheral wall sections 6*b* and mandrel sections 7*b* or cavity sections, and may preferably also be of identical construction on the outside and thus as a whole, and may therefore be identical parts. Since, as a result of the central disposition of the dividing seam 12 with respect to the annular cavity 9, the length of the peripheral wall sections 6*a*, 6*b* and mandrel sections 7*b* is reduced and the said parts are more stable as a result of this reduction, it is possible to dispense with a centering disc ic, as FIGS. 7 and 7*c* show. However, it is also possible, within the scope of the invention, to support at least one of the mandrel sections 7*a*, 7*b*, and preferably both mandrel sections 7*a*, 7*b*, by a centering disc 1*c* in each case, as is indicated in chain-dotted lines in FIGS. 7 to 7*c*. In this exemplified embodiment, the cover part 1*b* is to be shortened, in a metal-cutting manner, to the dimension e in FIG. 7*c*, either before or after the welding of the base body part 1*a* to the said cover part 1*b*. Although this presupposes a certain wastage of material, it nevertheless achieves the advantage that the base body part 1*a* and cover part 1*b* are identical, at least on the cavity side, and therefore only one device in each case is required for manufacturing the said parts. Moreover, this reduces the number of individual parts, which simplifies the manufacturing process as a whole and makes it possible to lower the manufacturing costs.

The exemplified embodiment according to FIGS. 8 to 8*c*, in which identical or comparable parts are designated by the same reference symbols, differs from the exemplified embodiments described above in that the cover part 1*b* is formed by a disc having a central hole 19, in particular a through-hole, which is adapted to the cross-sectional size of the mandrel 7, the said mandrel 7 extending into the said hole 19 and the peripheral wall 6 extending as far as disc-shaped cover part 1*b*. Under these circumstances, the mandrel 7 may extend, in the case of a through-hole 19, as far as the end face of the cover part 1*b*, as FIG. 8*c* shows. In this design, the cover part 1*b* may be connected to the base body part 1*a* by soldering or welding, that is to say, for example, at the abutment faces between the cover part 1*b* and the peripheral wall 6 on the one hand, and between the wall of the hole 19 and the superficies of the mandrel 7 on the other. The parts are preferably connected to one another by laser welding. In other respects, the hollow piston 1 in this exemplified embodiment can be manufactured by means of the process steps already described. In that connection, the cover part 1*b* may be formed in one piece, for example by sintering, or may be machined in a metal-cutting manner, in particular by turning.

In all the exemplified embodiments, the hollow piston 1 may form, with a sliding block 22 which is represented only in FIG. 1 in outline form and which is connected to the hollow piston 1 by a joint connection 23, a piston arrangement 24 which permits axial support and axial driving of the hollow piston 1 in a piston-engine having an oblique disc for displacing the said hollow piston 1. In the present exemplified embodiment, in which the joint part 4 is formed by a joint ball 5, the sliding block 22 has, on its side that faces towards the hollow piston 1, a hemispherical joint recess 25 whose rim 26 is prolonged beyond the equator 27 of the said joint recess 25 and is flanged into a shape which engages behind the joint ball 5, guaranteeing clearance of motion. The opposite face of the sliding block (22) from the joint recess 25 is a preferably flat sliding face 28 which serves for support, in a manner capable of articulating movement, against the oblique disc. The sliding block 22 consists of metal, for example of a copper or brass alloy such as bronze, or of steel. The rim 26 of the recess may be cold flanged or hot flanged. This flanging operation may take place before the finish 25 machining of the superficies 18 of the hollow piston, or as a final machining step after the finish-machining of the said superficies 18 of the hollow piston 1.

When a coaxially continuous bore 21 is present in the hollow piston 1, a bore section 21a which is in communication with the said continuous bore and which terminates at the sliding face 28, is also present in the sliding block 22. The said sliding block 22 also has a flange 29 which projects radially beyond the base section 31 having the joint recess 25.

Within the scope of the invention, the joint connection 23 can also be formed through the fact that the joint recess 25, together with the rim 26 of the recess, are disposed on the hollow piston 1 and extend in the direction of the sliding block 22, and the said sliding block 22 has the joint ball 5 which is pivotably mounted in the joint recess 25.

What is claimed is:

1. Process for manufacturing a hollow piston (1) for a piston engine, having a closed annular cavity (9), comprising the following process steps:

constructing a first piston part (1*a*) with a diametral oversize (x) with a base section (3) from which a joint part (4), or a material extension for the said joint part (4), extends in one axial direction, and from which a peripheral wall (6) that delimits the annular cavity (9) on the outside and a mandrel (7) that delimits the annular cavity (9) on the inside extent in the other axial direction, in one piece in each case, constructing a second piston part (8) with a diametral oversize (x) in the form of a cover (8), connecting the first and second piston parts (1*a*, 8), by friction welding, and finally machining the superficies (18) of the hollow piston (1) or of the joint part (4), wherein the peripheral wall (6) and the mandrel (7) are simultaneously formed on the base part (3) through extrusion.

2. Process according to claim 1, wherein the cover (8) is constructed with a peripheral wall section (6*a*) that delimits the annular cavity (9) on the outside, and with a mandrel section (7*a*) that delimits the annular cavity (9) on the inside, and the peripheral wall section (6*a*) and the mandrel section (7*a*) are simultaneously formed on the cover (8) through extrusion.

3. Process according to claim 1 or 2, wherein the peripheral wall (6), the peripheral wall section, sections (6*a*, 6*b*), and the mandrel (7), the mandrel section, and sections (7*a*, 7*b*) are selectively formed on through cold extrusion.

4. Process for manufacturing a hollow piston (1) for a piston engine, having a closed annular cavity (9), comprising the following process steps:

constructing a first piston part (1*a*) with a diametral oversize (x) with a base section (3) from which a joint part (4), or a material extension for the said joint part (4), extends in one axial direction, and from which a peripheral wall (6) that delimits the annular cavity (9) on the outside and a mandrel (7) that delimits the annular cavity (9) on the inside extent in the other axial direction, in one piece in each case, constructing a second piston part (8) with a diametral oversize (x) in the form of a cover (8), connecting of the first and second piston parts (1*a*, 8), by friction welding, and finally machining of the superficies (18) of the hollow piston (1) or of the joint part (4), wherein the first piston part (1*a*) with the peripheral wall (6) and mandrel (7) are formed by sintering.

5. Process for manufacturing a hollow piston (1) for a piston engine, having a closed annular cavity (9), comprising the following process steps:

constructing of a first piston part (1*a*) with a diametral oversize (x) with a base section (3) from which a joint part (4), or a material extension for the said joint part (4), extends in one axial direction, and from which a peripheral wall (6) that delimits the annular cavity (9) on the outside and a mandrel (7) that delimits the annular cavity (9) on the inside extend in the other axial direction, in one piece in each case, constructing a second piston part (8) with a diametral oversize (x) in the form of a cover (8), connecting the first and second piston parts (1*a*, 8), by friction welding, and finally machining of the superficies (18) of the hollow piston (1) or the joint part (4), wherein the cover (8) is constructed with a peripheral wall section (6*a*) that delimits the annular cavity (9) on the outside, and with a mandrel section (7*a*) that delimits the annular cavity (9) on the inside, and the peripheral wall section (6*a*) and the mandrel section (7*a*) are simultaneously formed on the cover (8) and the first piston part (1*a*) with the peripheral wall section (6*b*) and mandrel section (7*b*), and the second piston part (1*b*) with the peripheral wall section (6*a*) and mandrel section (7*a*), are selectively formed by sintering.

6. Process according to claim 2 or 5, wherein the base section (3) and the cover (8) are constructed with peripheral wall sections (6*a*, 6*b*) and mandrel sections (7*a*, 7*b*) of equal length.

7. Process for manufacturing a hollow piston (1) for a piston engine, having a closed annular cavity (9), comprising the following process steps:

constructing a first piston part (1*a*) with a diametral oversize (x) and with a base section (3) from which a joint part(4), or a material extension for the said joint part (4), extends in one axial direction, and from which a peripheral wall section (6*b*) that delimits the annular cavity (9) on the outside and a mandrel section (7*b*) that delimits the annular cavity (9) on the inside extend in the other axial direction, in one piece in each case, constructing a second piston part (1*b*) with a radial oversize (x) in the form of a cover (8) with a peripheral wall section (6*a*) that delimits the annular cavity (9) on the outside, and with a mandrel section (7*a*) that delimits the annular cavity (9) on the inside, said first piston part (1*a*) and said second piston part (1*b*) being formed from identical prefabricated parts, connecting the peripheral wall sections (6*a*, 6*b*) and the mandrel sections (7*a*, 7*b*), by welding, and finally machining of the superficies (18) of the hollow piston (1) or else of the joint part (4), wherein the peripheral wall sections (6*a*, 6*b*) and the mandrel sections (7*a*, 7*b*) are each constructed with an equal axial length.

8. Process according to any one of claims 1, 2 or 4, wherein the peripheral wall (6), the peripheral wall section, sections (6*a*, 6*b*), the mandrel (7), and the mandrel section and sections (7*a*, 7*b*) are formed on through cold extrusion.

9. Process according to any one of claims 1, 2 or 4, wherein the first piston part (1*a*) with the peripheral wall (6), peripheral wall section (6*b*), mandrel (7), mandrel section (7*b*), and the second piston part (1*b*) with the peripheral wall section (6*a*) and mandrel section (7*a*), are formed by sintering.

10. Process according to claim 1, wherein identical prefabricated parts are used for the first piston part (1*a*) and the second piston part (1*b*).

* * * * *